US006036477A

United States Patent [19]

Frandsen

[11] Patent Number: 6,036,477

[45] **Date of Patent: *Mar. 14, 2000**

[54] INDEFINITELY REUSABLE CANDLE

[76] Inventor: Sue C. Frandsen, 9043 Leaside, Dallas, Tex. 75238

[ * ] Notice: This patent issued on a continued prosecution application filed under 37 CFR 1.53(d), and is subject to the twenty year patent term provisions of 35 U.S.C. 154(a)(2).

[21] Appl. No.: 08/943,437

[22] Filed: Oct. 3, 1997

[51] Int. Cl.[7] ..... F23D 3/16

[52] U.S. Cl. ..... 431/291; 431/289; 431/325; 362/161

[58] Field of Search ..... 425/803; 431/292, 431/288, 289, 291, 325; 362/161

[56] References Cited

U.S. PATENT DOCUMENTS

| | | | |
|---|---|---|---|
| 2,354,343 | 7/1944 | Webber et al. | 431/289 |
| 2,481,019 | 9/1949 | Joyce . | |
| 2,713,256 | 7/1955 | Oesterle et al. | 431/292 |
| 2,974,509 | 3/1961 | Penke . | |
| 3,741,711 | 6/1973 | Bryant | 431/125 |
| 3,806,723 | 4/1974 | Ollom | 431/289 |
| 3,898,039 | 8/1975 | Lin | 431/288 |
| 4,568,270 | 2/1986 | Marcus et al. | 431/288 |
| 4,917,597 | 4/1990 | Henze | 431/291 |
| 5,395,233 | 3/1995 | Karp | 431/126 |
| 5,597,300 | 1/1997 | Wohi et al. | 431/288 |

*Primary Examiner*—Carl D. Price
*Attorney, Agent, or Firm*—Fulbright & Jaworski L.L.P.

[57] ABSTRACT

A composite candle including an exterior shell of candle wax having at least one circular and/or specially-shaped inner core region in which a wick is positioned. When the wick is ignited, provision is made for consuming only that wax contained in the inner core region so as to create a core-sized cavity of a size to subsequently receive a candle core replacement adapted for insertion into the cavity. The exterior shell is not melted by the heat of the candle flame, and candle core replacements may therefore be employed indefinitely. Also included is a method of making composite candles in which one or more cavity-defining inserts are installed within a shell, and candle wax is then poured within the insert(s) and the region(s) between the insert(s) and an exterior surface-defining mold.

3 Claims, 2 Drawing Sheets

INDEFINITELY REUSABLE CANDLE

BACKGROUND OF THE INVENTION

This invention relates to chandlery and more particularly to indefinitely reusable candles and improved methods of manufacture.

A variety of reusable candles have heretofore been proposed, illustrative of which are those described in U.S. Pat. No. 2,481,019 granted to James A. Joyce U.S. Pat. No. Sep. 6, 1949; U.S. Pat. No. 2,974,509 granted to Aladar J. Penke Mar. 14, 1961; U.S. Pat. No. 3,741,711 granted to Gladys Bryant Jun. 26, 1973; and U.S. Pat. No. 5,597,300 granted to Michael C. Wohl Jan. 28, 1997. According to some of these proposals, relatively large dimension (e.g., diameter) outer shells are provided within which there are disposed wells or recesses into which smaller replacement candle elements may be successively disposed. Thus, the exterior shells may be employed indefinitely, with just the consumable inserts replaced.

The foregoing proposals, however, involved the utilization of waxes of differing melting temperatures, ornamentation, insulated inserts, or special effects additives, thereby adding to cost and complexity. Accordingly, there has continued to be a need for simplification, ease of fabrication and cost reduction.

BRIEF SUMMARY OF THE INVENTION

The reusable candle of the present invention is characterized by its relative simplicity and its particular adaptability to use with a variety of candle inserts, e.g., votive candle inserts and the like. It includes an outer shell which, in one preferred embodiment, has substantially cylindrical concentric inner and outer surfaces. When manufactured, the base and outer shell are initially cast of candle wax using a relatively simple exterior mold in combination with an essentially concentric insert to create a relatively thick exterior wall having an essentially concentric inner well of uniform radius open at its upper extremity. When the outer shell has hardened (solidified), a wick is positioned along the cylindrical axis of the well, and consumable candle wax is then poured into the well to fill it to the desired level, thus creating an inner solid cylindrical insert of consumable candle wax. When the candle is burned, only a part of the inner cylindrical insert is consumed, thus creating a cylindrical cavity into which replacement inserts (such as conventional votive candles in glass, or candles in plastic, dolomite, or stainless steel) may be successively inserted to provide for multiple re-use. As an alternative to, or in addition to, the use of candle wax for the outer shell, other substances may be included in the outer shell. Thus, for example, there may be included substances such as ceramics.

In another embodiment, the wick is positioned within the well region before wax is poured for either the walls of the composite shell or the inner core of the candle; and candle wax is poured to simultaneously form both the shell and inner core.

As employed herein, the term "candle wax" includes the petroleum based waxes, beeswax, bayberry wax, artificial beeswax and other similar waxes that are suitable for use in candles.

OBJECTS AND FEATURES OF THE INVENTION

It is one general object of the invention to improve reusable candles.

It is another object of the invention to simplify manufacture and use of such candles.

It is yet another object of the invention to improve appearance and cost effectiveness of reusable candles.

Accordingly, in accordance with one feature of a first embodiment of the invention, a generally cylindrical outer mold is provided within which an essentially concentric insert is positioned; and the insert is retained within the candle structure after pouring of wax into the space between its outer surface and the inner surface of the exterior mold, thus enabling use of a single mold in a composite structure.

In accordance with another feature of the first embodiment of the invention, the aforementioned concentric insert acts as a wall to define the radial distance of wax melt about a central wick within the candle, thus facilitating creation of a well into which refill candles may be advantageously positioned.

In accordance with yet another feature of the invention, the insert may be provided with an ornamental cross section such as a star, thus imparting versatility.

In accordance with still another feature of the first embodiment of the invention, the aforementioned wick is sized to a length equal to the depth within the candle to which burning is desired plus a length desired for initial exposure above the wax level at the surface for lighting, thus providing for initial burning only to the desired depth and thereby creating a cavity of the desired depth.

In accordance with a feature of an alternate embodiment of the invention, a composite candle is prepared by placing an inverted cup of the desired cavity size in the bottom center of the exterior mold and then pouring candle wax into the mold to surround the exterior surface of the cup, thereby facilitating the inclusion of a cup in what subsequently becomes the upper exposed surface of the composite candle.

These and other objects and features of the invention will be apparent from the following description, by way of example of preferred embodiments, with reference to the drawing.

DESCRIPTION OF A PREFERRED EMBODIMENT

Figure 1:
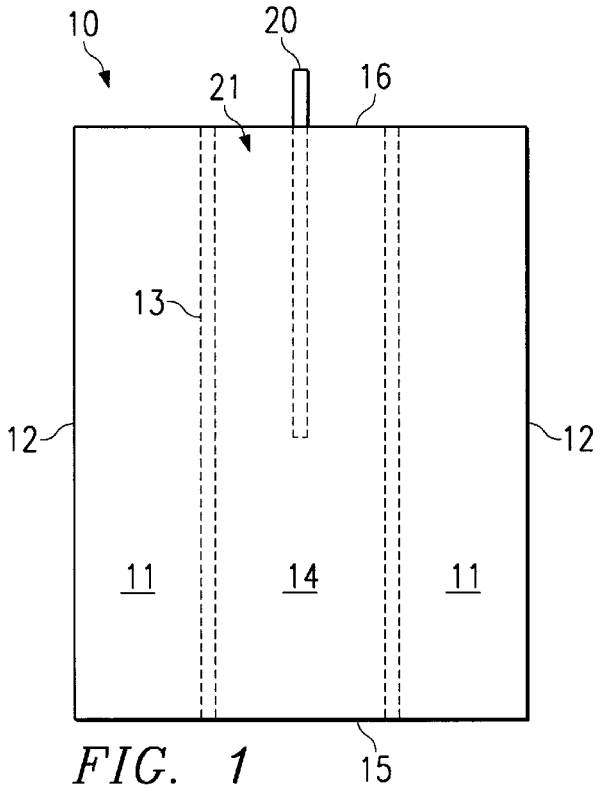
FIG. 1 is a front elevation view of a composite indefinitely reusable candle constructed according to a first embodiment of the invention.

Now turning to the drawing, and more particularly FIG. 1 thereof, it will be seen to depict a first preferred embodiment of the invention in the form of a composite candle generally shown at 10. This first preferred embodiment comprises a substantially cylindrical outer sheath 11 of candle wax extending entirely about the periphery of the candle and defining an exterior exposed wall of the candle as at 12. Within the candle, and defining the inner wall of sheath 11 is wall 13. Wall 13 defines a cavity 14 which extends vertically from the base 15 of the candle 10 to top 16. Contiguous to wall 13 is the outer wall 17 of a cylindrical insert 18 which has an inner wall 19 defining cavity 14 as mentioned above. Preferably centrally positioned along the vertical center axis of candle 10 is candle wick 20 fully immersed in solidified candle wax 21 which fills cavity 14.

Figure 3:
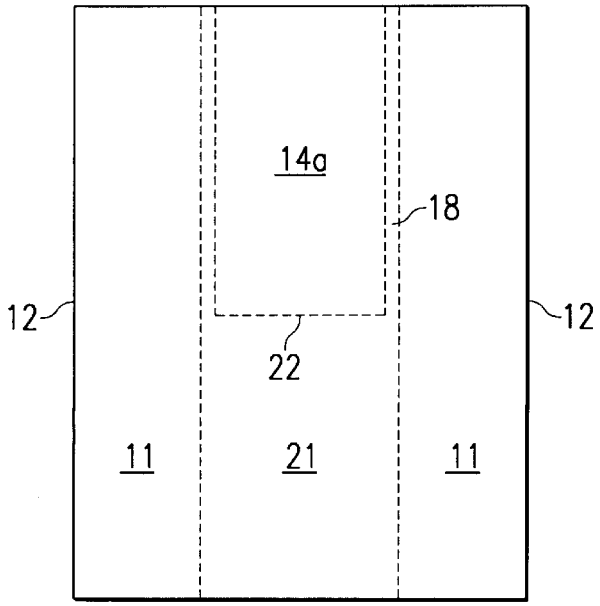
FIG. 3 is a front elevation view similar to that of FIG. 1 but illustrating the candle after it has consumed all its burnable wax after its first burning.

When the candle 10 is burned the first time, it continues to burn (unless overtly extinguished) until the level of interior candle wax 21 drops to the bottom of the wick 20, whereupon, the wick is completely consumed, and the condition of the candle is as shown in FIG. 3. There, it will be seen, are the outer sheath 11 surrounding the insert which, in the space above dashed line 22 is empty, thus creating an empty upper portion 14*a* of original cavity 14. Below dashed line 22, the wax remains in place, thus continuing to fill the lower part 14*b* of original cavity 14. It will now be evident that to reuse the candle 11, it is only necessary to drop a small candle into empty upper portion 14*a* of cavity 14; and when that replacement candle is consumed, to replace it with others successively so that the outer sheath continues to be reusable indefinitely.

Figure 4:
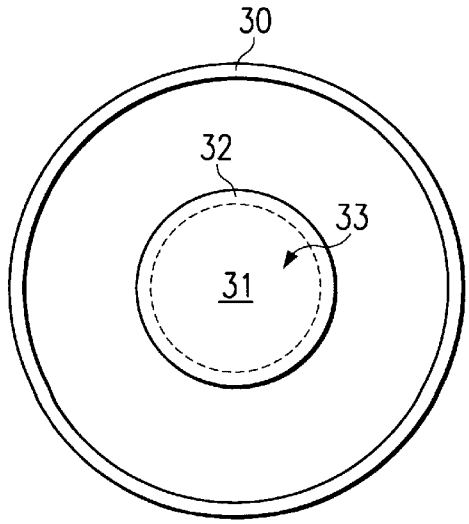
FIG. 4 is a top view of a mold for making a second embodiment of the invention, illustrating the inverted position of a non-flamable cup-shaped insert in place and ready for a first pouring of wax.
Figure 5:
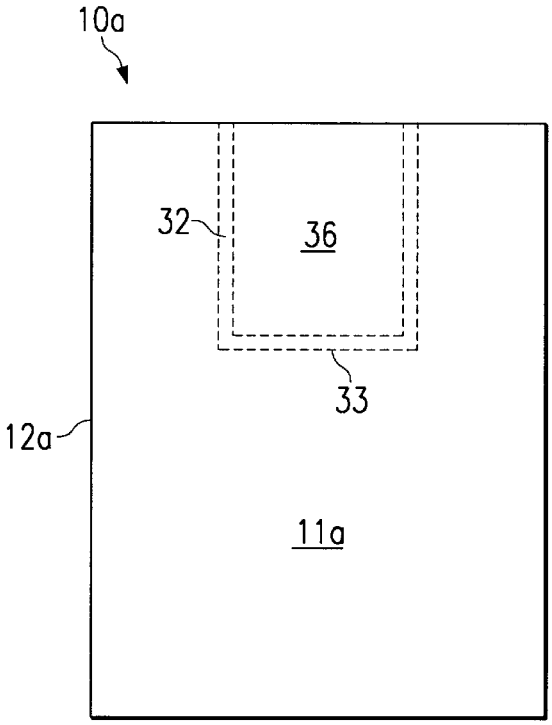
FIG. 5 is a front elevation view of the candle of the second embodiment after a first wax pour and prior to a second pour.

The remaining figures illustrate a second preferred embodiment together with its method of fabrication. There, as mentioned above with respect to FIG. 4, there is shown a top view of a mold for making such second embodiment. Positioned in the center of the mold 30 there is an inverted cup 31, for example glass, thermoplastic, metal or ceramic having thin walls 32 and a bottom (when the cup is reinverted to its normal upright position) 33. Candle wax is then poured into the mold to fill it to the desired level. After cooling and solidifying, mold 30 is inverted and removed, thus leaving an intermediate composite as shown in FIG. 5. There, in FIG. 5, are seen the outer surface 12*a* of a modified sheath 11*a* surrounding an empty single non-flamable cup-shaped insert 31 cast into composite candle 10*a*.

Following creation of the intermediate composite depicted in FIG. 5, a wick 35 is installed in insert 31 and the empty space 36 (FIG. 5) is filled with candle wax 37 poured therewithin to essentially fill space 36. Surface 37A is shown to reside slightly below the upper surface 16*a* of the sheath 11*a* so as to illustrate any shrinkage that may occur upon cooling. However, such surfaces may be essentially co-planar; or in some instances surface 37A may actually extend slightly higher than surface 16*a*.

Figure 2:
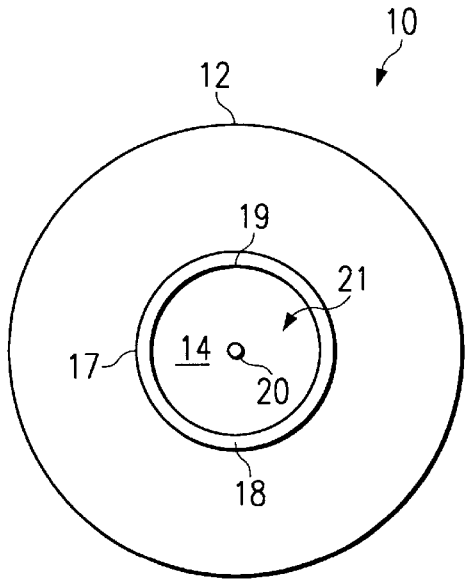
FIG. 2 is a top view of the candle of FIG. 1.
Figure 6:
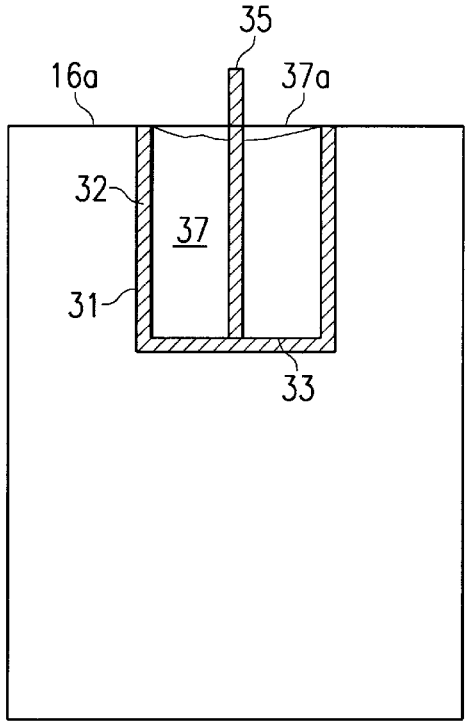
FIG. 6 is a sectional view of the candle of FIG. 5 taken through the center thereof after wick and inner wax have been added.
Figure 7:
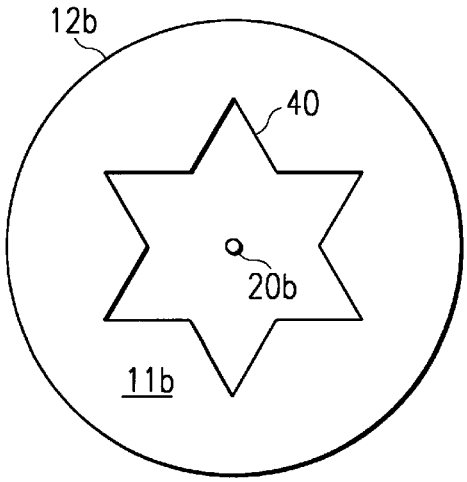
FIG. 7 is a top view of a composite candle with a star-shaped insert therein.
Figure 8:
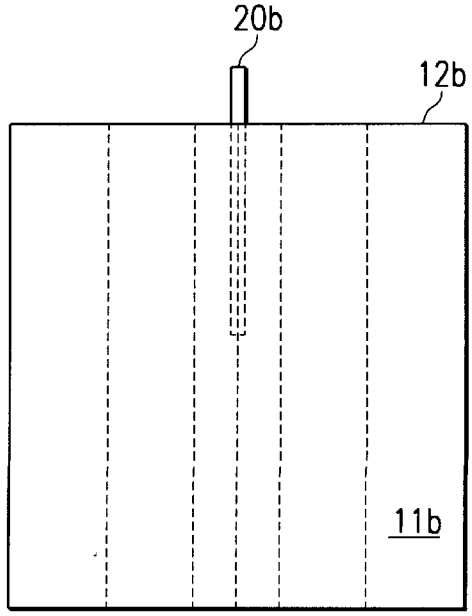
FIG. 8 is a front elevation view of the composite candle of FIG. 7.

Turning now to FIG. 7, there will be seen a top view of a composite candle generally similar to the composite candle of FIG. 6 with a star-shaped insert therein and otherwise generally similar to the composite of FIGS. 1–3. As mentioned above, FIG. 8 is a front elevation view of the composite candle of FIG. 7. In FIGS. 7 and 8 there are seen the above-described exterior wall 12*b* of exterior sheath 11*b*, candle wick 20*b*, and insert 40 which has a star-shaped cross section as shown. It will thus be evident that the cylindrical inserts and the cups described above could readily be made into special shapes such as the star-shape shown in FIGS. 7 and 8. It will also be evident that instead of a star shape, the insert could be any one or more of a variety of cross-section shapes such as a rectangle, trapezoid, pentagon, hexagon, septagon, or octagon.

It will now be evident that there has been described herein an improved reusable candle which provides an improvement in simplicity.

Although the invention hereof has been described by way of preferred embodiments, it will be evident that adaptations and modifications may be employed without departing from the spirit and scope thereof. Thus, for example, an insert cylinder or cup such as those described hereinabove, may be disposed other than at the central axis of a cylindrical outer sheath. Moreover, it should be understood that a plurality of cylindrical or cup-shaped inserts (including combinations thereof) may be disposed within the exterior sheath, thus providing for multiple replacements.

The terms and expressions employed herein have been used as terms of description and not of limitation; and thus, there is no intent of excluding equivalents, but on the contrary it is intended to cover any and all equivalents that may be employed without departing from the spirit and scope of the invention.

What is claimed is:

1. A reusable candle comprising an exterior sheath of peripheral candle wax extending entirely about the periphery of said candle and defining an exterior wall of said candle, said sheath having an inner wall surface, a glass insert disposed within said candle contiguous with said inner wall surface, said insert defining a cavity within said candle extending entirely through said candle, said insert being affixed by solidified molten wax introduced into said cavity to fill said cavity, a wick centrally positioned within said glass insert surrounded by interior candle wax essentially filling said insert, and means including said wick effective when said wick is ignited, for progressively consuming only said interior candle wax within said insert while retaining said exterior sheath of peripheral candle wax.

2. A reusable candle comprising an exterior sheath of peripheral candle wax extending entirely about the periphery of said candle and defining an exterior wall of said candle, said sheath having an inner wall surface, a ceramic insert disposed within said candle contiguous with said inner wall surface, said insert defining a cavity within said candle extending entirely through said candle, said insert being affixed by solidified molten wax introduced into said cavity to fill said cavity, a wick centrally positioned within said ceramic insert surrounded by interior candle wax essentially filling said insert, and means including said wick effective when said wick is ignited, for progressively consuming only said interior candle wax within said insert while retaining said exterior sheath of peripheral candle wax.

3. A reusable candle comprising an exterior sheath of peripheral candle wax extending entirely about the periphery of said candle and defining an exterior wall of said candle, said sheath having an inner wall surface, a metallic insert disposed within said candle contiguous with said inner wall surface, said insert defining a cavity within said candle extending entirely through said candle, said insert being affixed by solidified molten wax introduced into said cavity to fill said cavity, a wick centrally positioned within said metallic insert surrounded by interior candle wax essentially filling said insert, and means including said wick effective when said wick is ignited, for progressively consuming only said interior candle wax within said insert while retaining said exterior sheath of peripheral candle wax.

* * * * *